United States Patent [19]

Iwasaki et al.

[11] 4,218,598

[45] Aug. 19, 1980

[54] SWITCH-LATCHING MECHANISM

[75] Inventors: Sadayoshi Iwasaki; Masao Kumagaya, both of Furukawa, Japan

[73] Assignee: Alps Electric Co., Ltd., Tokyo, Japan

[21] Appl. No.: 897,784

[22] Filed: Apr. 19, 1978

Related U.S. Application Data

[63] Continuation of Ser. No. 663,263, Mar. 3, 1976, abandoned.

[30] Foreign Application Priority Data

Mar. 4, 1975 [JP] Japan ..... 50/29268

[51] Int. Cl.[2] ..... H01H 13/56

[52] U.S. Cl. ..... 200/153 J

[58] Field of Search ..... 200/153 J, 159 R, 160, 200/325, 328

[56] References Cited

U.S. PATENT DOCUMENTS

| | | | |
|---|---|---|---|
| 3,376,504 | 1/1968 | Lockard | 200/153 T |
| 3,493,705 | 2/1970 | Noll et al. | 200/153 J X |
| 3,582,592 | 6/1971 | Schadow | 200/159 R |
| 3,624,328 | 11/1971 | Hansen | 200/153 J |
| 3,697,713 | 10/1972 | Ohkita | 200/153 J |
| 3,704,353 | 11/1972 | Halla | 200/153 J |
| 3,707,610 | 12/1972 | Davies | 200/153 J |
| 3,732,386 | 5/1973 | Ohkita | 200/153 J |

FOREIGN PATENT DOCUMENTS

| | | | |
|---|---|---|---|
| 1233456 | 2/1967 | Fed. Rep. of Germany | 200/153 J |

*Primary Examiner*—William D. Martin, Jr.

*Attorney, Agent, or Firm*—Guy W. Shoup; Gerard F. Dunne

[57] ABSTRACT

An end of a stiff wire latching member is slidable in a heart shaped groove of a slider in such a manner that the slider latches in a depressed position when pushed once and unlatches when pushed again. A compression spring retained by a cap member urges the end of the wire into the groove to ensure proper operation. In one embodiment of the invention a cap member which retains the spring is formed with an elongated hole through which the wire may be passed for assembly, after which the spring is inserted and retained together in this manner for assembly with the slider.

4 Claims, 6 Drawing Figures

SWITCH-LATCHING MECHANISM

This application is a continuation of our copending application Ser. No. 663,263 filed Mar. 3, 1976 now abandoned.

The present invention relates to a latching mechanism for a switch.

Various switch-latching mechanisms are known in the prior art. The present switch-latching mechanism is advantageous over the prior art in that it ensures reliable latching operation, comprises few parts and enables ease of assembly.

SUMMARY OF THE INVENTION

The present-switch latching mechanism comprises a stiff wire, an end of which is slidable in a heart shaped groove of a slider in such a manner that the slider latches in a depressed position when pushed once and unlatches when pushed again. A compression spring retained by a cap member urges the end of the wire into the groove to ensure proper operation.

It is therefore an object of the present invention to provide a switch-latching mechanism which is reliable, comprises few parts and is easy to assemble on a mass production basis.

BRIEF DESCRIPTION OF THE DRAWINGS

The above and other objects, features and advantages of the present invention will become clear from the following detailed description taken with the accompanying drawings, in which.

DESCRIPTION OF THE PREFERRED EMBODIMENTS

Figure 1:
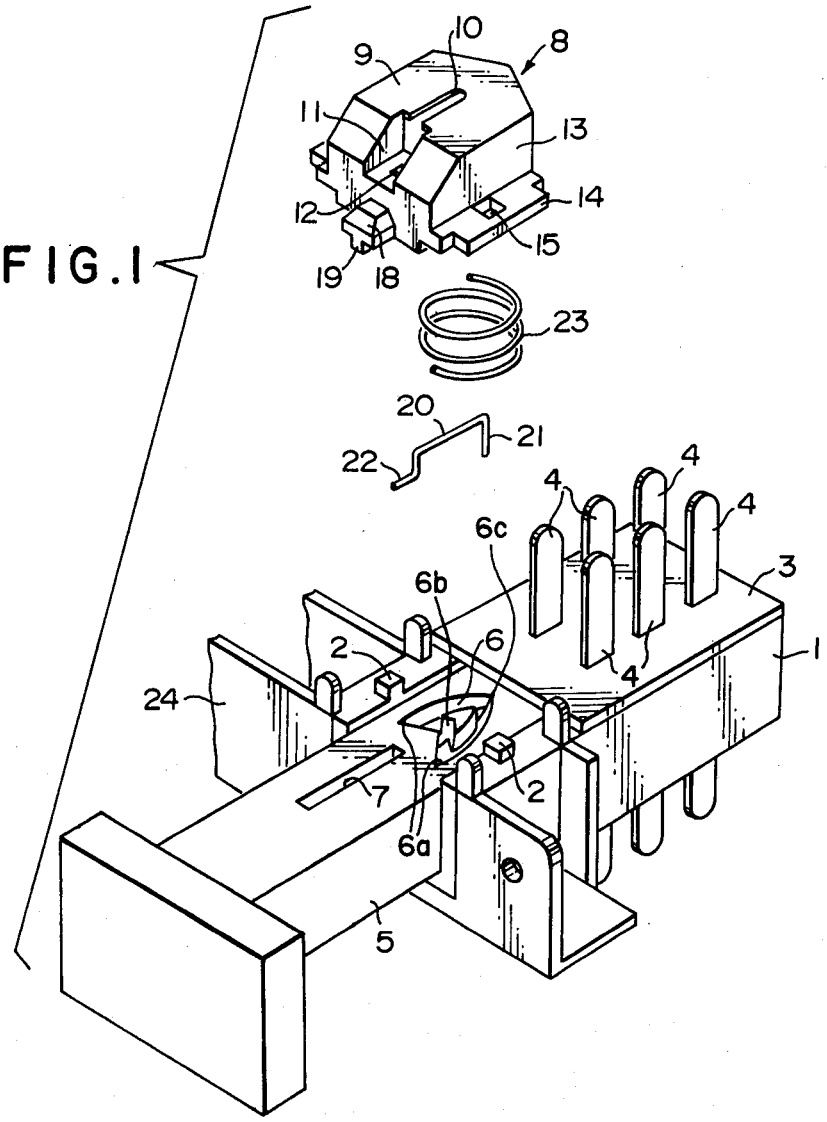
FIG. 1 is an exploded view of a first embodiment of a switch that incorporates a switch-latching mechanism in accordance with the present invention.

Referring now to FIGS. 1 to 4 in combination, a switch comprises a body 1 made of an insulating material, such as plastic, which is formed with projecting tabs 2. The body 1 is fitted with an insulating cover 3 through which terminals 4 project. A slider 5 is slidably retained by the body 1 and cover 3 and has a contact fixed thereto (not shown) which is operatively engagable with the terminals 4. Hence, as the position of slider 5 is changed, the contact fixed thereto will electrically connect different pairs of the terminals 4, in the conventional manner. The slider 5 is formed with a heart shaped cam or latching groove generally indicated by 6 and a longitudinal stopper groove 7.

A cap 8 is fixed to the body 1 by means of holes 15 formed through flanges 14 which tightly engages with the projecting tabs 2. The cap 8 has sides 13 and a top 9 which is formed with a recess 11 which opens into the interior of the cap 8. A hole 12 is formed through the bottom of the cap 8 in the bottom of the recess 11. An extension 18 of the cap 8 is formed with a projection 19 which projects into the elongated groove 7 of the slider 5.

A latching member in the form of a stiff wire 20 is bent so as to have one end 22 horizontally rockably retained by the hole 12 and another end 21 slidably engaging in the groove 6. A compression spring 23 is retained in the cap 8 so as to urge the end 21 of the wire 20 into the groove 7. The body 1 is connected to a mounting flange 24.

Figure 2:
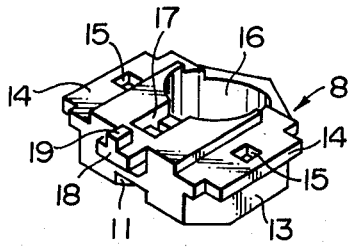
FIG. 2 is a perspective view from below of a cap member of the switch of FIG. 1.
Figure 3:
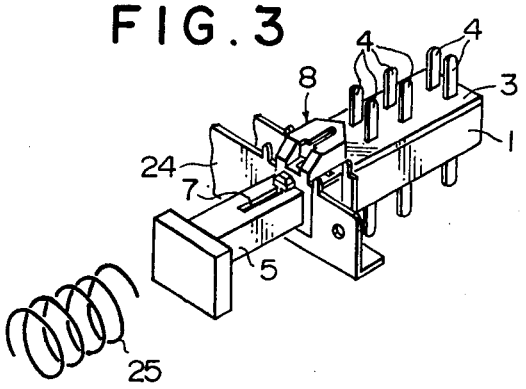
FIG. 3 is a partially exploded perspective view of the switch of FIG. 1 in unlatched (extended) position.

As shown in FIG. 2, the bottom of the cap 8 is formed with a cylindrical bore 16 in which the spring 23 is retained and a recess 17 leading from the bore 16 in the area of the hole 12. A return spring 25 urges the slider 5 out of the body 1 toward an unlatched position.

Figure 4:
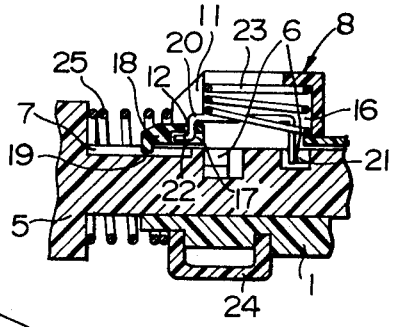
FIG. 4 is a cross section of the switch of FIG. 1.

To move the switch from an unextended position to the extended position shown in FIG. 4, the switch operator first pushes the slider 5 into the body 1. The end 21 of the wire, which had been kept in the V-shaped base of the heart-shaped projection 6*b* by the pressure of spring 25 and which is always pressed against the bottom of the groove 6 by the spring 23, is forced to move to one of the conrners 6*a* of the groove 6. When the operator releases the slide 5, the wire will move to position 6*c* and prevents movement of the slide 5 out of the body 1. To reverse the process to the extended position of the slider 5 shown in FIG. 4, the slider is pushed in. The end of the wire 21 contacts and moves along a side of the heart-shaped projection 6*b*, from where it returns to the original position in the V-shaped base of the heart-shaped projection 6*b*.

The elongated opening 10 provides a convenient means of assembling the cap 8, wire 20 and spring 23 into a unit which can be easily mounted to the body 1. The wire 20 is held vertically and the end 22 inserted through the hole 12. The wire 20 is then rocked clockwise, as viewed in FIG. 4, so that the end 21 of the wire 20 rocks into the interior of the cap 8 through the elongated opening 10. The wire 20 is bent downwards to an extent such that the spring 23 may be compressed and inserted into the cap 8 from the lower right side thereof, as viewed in FIG. 4, between the wire 20 and the top 9. The spring 23 is retained by the wire 20 in this manner so that the cap 8, spring 23 and wire 20 form a unit which can be easily mounted on the body 1 without further manipulation of the spring 23 and wire 20.

This arrangement of the spring 23 and wire 20 ensures that the wire 20 is biased with the correct amount of torque to produce positive latching action. Replacement of the spring 23 and wire 20 is also easy. Proper selection of the stiffness of the spring 23 will provide a suitable amount of noise in the operation of the switch so that the operator will know that the latching mechanism is functioning properly.

Figure 5:
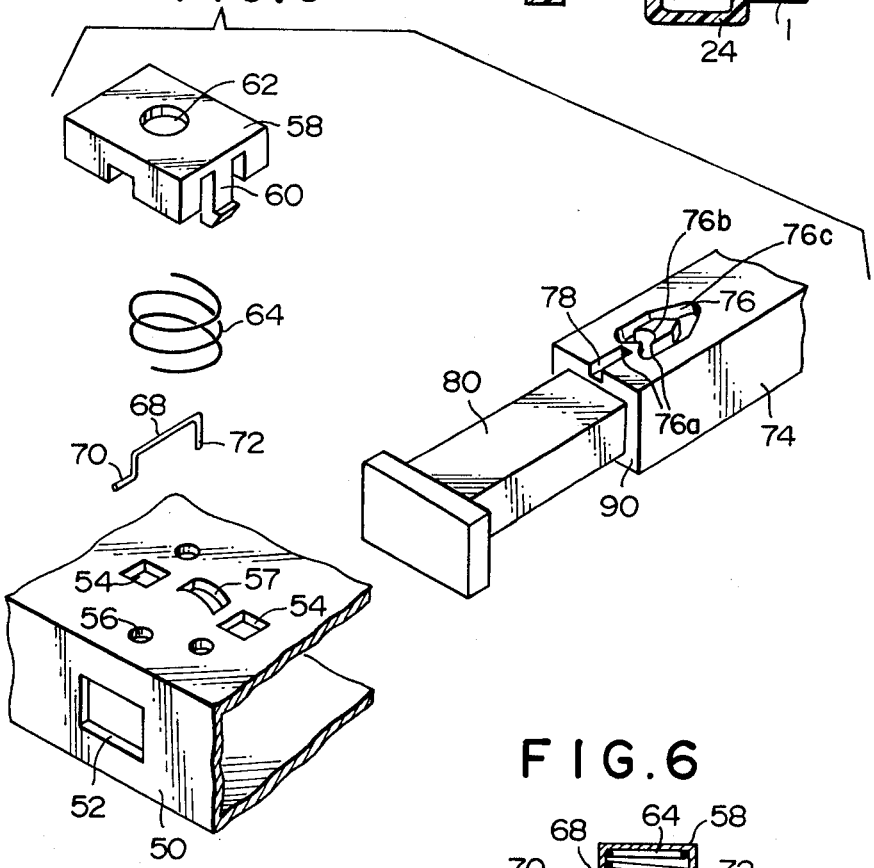
FIG. 5 is an exploded view of second embodiment of a switch incorporating a switch-latching mechanism according to the present invention in an unlatched (extended) position.
Figure 6:
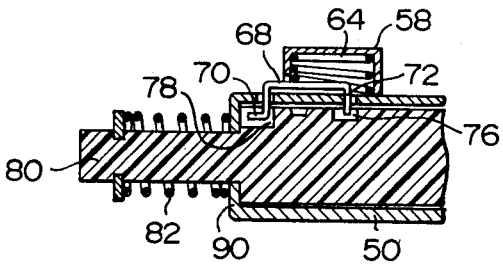
FIG. 6 is a cross section of the switch of FIG. 5.

Another embodiment of the present invention is shown in FIGS. 5 and 6. A body 50 is formed with a rectangular hole 52 and holes 54, 56 and 57 through the top thereof. A cap 58 which retains a compression spring 64 is fixed to the body 50 by means of tabs 60 which engage in the holes 54. An end 70 of a stiff wire 68 is horizontally rockably retained by the hole 56. A slider 74 has a portion 80 which is slidable through the hole 52 in the body 50, and is formed with a heart shaped groove generally indicated as 76. An end 72 of the wire 68 is urged downward to engage with the bottom of the groove 76 by the spring 64. A hole 62 is formed through the top of the cap 58 so that a proper amount of noise will be heard by the switch operator to confirm the operation of the switch.

The embodiment of FIGS. 5 and 6 generally operates in the same manner as the embodiment of FIGS. 1 to 4. Movement of the slider 74 out of the body 50 may be limited by abutment of a step 90 against the inner wall of the body 50. The end 70 of the wire 68 may be adapted to project into a longitudinal groove 78 in the slider 74 to serve as a stopper through abutment of the inner end of the groove 78 thereagainst. The inner surface of the top of the body 50 may be formed with a projection (not shown) to project into the groove 78.

To assemble the mechanism, the wire 68 is held vertically and the end 70 is inserted into the hole 56. The wire 68 is then rocked downward so that the end 72 projects through the hole 57 into the groove 76. The spring 64 is inserted into the cap 58, and the cap 58 and spring 64 are fixedly snapped onto the body 50 by means of the tabs 60. A compression spring 82 to return the slider 74 to its outermost or unlatched position is shown in FIG. 6.

What is claimed is:

1. A switch-latching mechanism comprising:

a body comprised of an electrically insulating material;

a plurality of electrically conductive terminals protruding from said body;

a slider comprised of an electrically insulating material and being retained slidably by said body, said slider having an end portion disposed interiorily of said body and carrying an electrical contact adapted to engage selected ones of said terminals upon sliding movement of said slider into either of two stable positions, said slider further having a generally heartshaped latching groove;

resilient means operatively associated with said slider for biasing it into one of said two stable positions;

an elongate latching member having an end portion projecting slidably into said latching groove for holding said slider in one of said two stable positions;

a compression spring biasing said latching member end portion downwardly into said latching groove; and a cap member fitting over and housing said compression spring and adapted to be mounted with said housed compression spring to said body for holding said spring to bias said latching member into said groove.

2. A switch-locking mechanism according to claim 1, said slider having a longitudinal stopper groove, said cap member including a projection extending into said stopper groove for engagement with an end thereof to limit movement of said slider.

3. A switch-latching mechanism according to claim 1, said slider having a longitudinal stopper groove, said cap member including a projection extending into said stopper groove for engagement with an end thereof to limit movement of said slider, and a hole for holding the other end of said latching member so it can pivot downwardly away from said cap member, whereby said latching member can be swung out of said cap member and said compression spring can be inserted therein prior to mounting said cap member to said body so that said cap member, latching member and compression spring can be assembled as a sub-unit of said switch.

4. A switch-latching mechanism according to claim 1, said slider having a longitudinal stopper groove, the other end portion of said latching member projecting into said stopper groove to limit movement of said slider.

* * * * *